US009332593B2

(12) United States Patent
Keite-Telgenbüscher et al.

(10) Patent No.: US 9,332,593 B2
(45) Date of Patent: May 3, 2016

(54) HEATING ELEMENT, AND HEATABLE PANE COMPRISING A HEATING ELEMENT

(75) Inventors: Klaus Keite-Telgenbüscher, Hamburg (DE); Bernd Lühmann, Norderstedt (DE); Alexander Prenzel, Hamburg (DE)

(73) Assignee: tesa SE, Norderstedt (DE)

( * ) Notice: Subject to any disclaimer, the term of this patent is extended or adjusted under 35 U.S.C. 154(b) by 1078 days.

(21) Appl. No.: 12/523,583

(22) PCT Filed: Jan. 10, 2008

(86) PCT No.: PCT/EP2008/050248

§ 371 (c)(1), (2), (4) Date: Sep. 3, 2009

(87) PCT Pub. No.: WO2008/090031

PCT Pub. Date: Jul. 31, 2008

(65) Prior Publication Data

US 2010/0059494 A1 Mar. 11, 2010

(30) Foreign Application Priority Data

Jan. 26, 2007 (DE) ..... 10 2007 004 953

(51) Int. Cl.

*H05B 1/00* (2006.01)
*H05B 3/86* (2006.01)
*H05B 3/12* (2006.01)

(52) U.S. Cl.

CPC .. *H05B 3/86* (2013.01); *H05B 3/12* (2013.01); *H05B 2203/013* (2013.01); *H05B 2214/04* (2013.01)

(58) Field of Classification Search

CPC ..... H05B 2203/013; H05B 2214/04; H05B 3/12; H05B 3/86

USPC ..... 219/201–270, 383–442, 443.1–468.2

See application file for complete search history.

(56) References Cited

U.S. PATENT DOCUMENTS 4,628,187 A * 12/1986 Sekiguchi ..... B60R 1/0602 219/505
5,181,006 A * 1/1993 Shafe ..... H05B 3/146 219/219

(Continued)

FOREIGN PATENT DOCUMENTS

| | | | |
|---|---|---|---|
| DE | 6926314 | U | 12/1969 |
| DE | 6944638 | U | 2/1970 |
| DE | 2908167 | A1 | 9/1980 |
| DE | 2910486 | A1 | 9/1980 |
| DE | 3418612 | A1 | 11/1984 |
| DE | 4019703 | A1 | 7/1991 |
| DE | 4139959 | A1 | 6/1993 |
| DE | 4390993 | T1 | 1/1995 |

(Continued)

OTHER PUBLICATIONS

T.G. Fox, Influence of Diluent and of Copolymer Composition on the Glass Temperature of a Polymer System; Session J; Am. Phys. Soc. 1; (1956) p. 123.

(Continued)

*Primary Examiner* — Mohammed Shamsuzzaman
(74) *Attorney, Agent, or Firm* — Norris McLaughlin & Marcus, P.A.

(57) ABSTRACT

A heating element including a current conductor through which electric power is conducted and electricity converted into heat by a voltage drop across an ohmic resistor. The heating element is a planar or a strip-shaped structure and is provided with at least one support layer and an adhesive layer, while the current conductor is designed as an additional, current-conducting layer which is arranged between the support layer and the adhesive layer. The support layer, the current-conducting layer, and the adhesive layer are transparent.

24 Claims, 2 Drawing Sheets

(56) References Cited

U.S. PATENT DOCUMENTS 5,206,482 A * 4/1993 Smuckler ..... B60R 1/0602 219/219
5,354,966 A * 10/1994 Sperbeck ..... H05B 3/36 219/203
5,418,025 A * 5/1995 Harmand ..... B32B 17/10036 219/203
5,904,874 A * 5/1999 Winter ..... A47G 1/02 219/203
6,084,217 A * 7/2000 Bulgajewski ..... 219/505
6,433,438 B2 * 8/2002 Koubuchi ..... H01L 21/336 257/776
6,518,633 B2 * 2/2003 Mori ..... H01L 21/76229 257/396
6,593,226 B2 * 7/2003 Travis ..... H01L 21/31053 257/E21.244
6,603,162 B1 * 8/2003 Uchiyama ..... G03F 9/7076 257/296
6,841,880 B2 * 1/2005 Matsumoto ..... H01L 21/78 257/207
6,879,025 B2 * 4/2005 Sasaki ..... H01L 21/3212 257/48
6,893,943 B2 * 5/2005 Ohsumi ..... H01L 23/544 257/620
6,989,582 B2 * 1/2006 Sniegowski ..... B81C 1/00873 257/620
7,009,233 B2 * 3/2006 Uchiyama ..... G03F 9/7076 257/296
7,015,118 B2 * 3/2006 Wakayama ..... B28D 1/221 257/620
7,033,650 B2 4/2006 Mauthner et al.
7,057,261 B2 * 6/2006 Jensen ..... G03F 7/70433 257/288
7,062,747 B2 * 6/2006 Horie ..... G03F 1/14 716/55
7,105,925 B2 * 9/2006 Boardman ..... H01L 21/76819 257/620
7,339,256 B2 * 3/2008 Nakamura ..... H01L 23/522 257/401
7,525,715 B2 * 4/2009 McCabe ..... G02F 1/157 359/238
7,545,024 B2 * 6/2009 Kida ..... B23K 26/032 257/620
7,554,202 B2 * 6/2009 Koubuchi ..... G03F 9/7076 257/183
7,554,211 B2 * 6/2009 Kida ..... H01L 21/78 257/618
7,618,878 B2 * 11/2009 Nakamura ..... B28D 5/0011 257/620
7,626,267 B2 * 12/2009 Koubuchi ..... G03F 9/7076 257/183
7,649,268 B2 * 1/2010 Kuo ..... H01L 22/34 257/620
7,678,684 B2 * 3/2010 Koubuchi ..... G03F 9/7076 438/624
7,692,319 B2 * 4/2010 Sogawa ..... H01L 23/544 257/620
7,696,607 B2 * 4/2010 Sano ..... H01L 21/78 257/620
7,723,826 B2 * 5/2010 Miyata ..... H01L 23/544 257/620
7,738,155 B2 * 6/2010 Agrawal ..... B60R 1/088 359/265
7,755,207 B2 * 7/2010 Sogawa ..... G03F 7/70633 257/620
7,968,259 B2 * 6/2011 Hoshino ..... B82Y 10/00 430/296
8,395,093 B1 * 3/2013 Auffinger, III ..... H05B 3/10 219/543
2001/0003054 A1 * 6/2001 Sumitani ..... H01L 22/20 438/401
2001/0017394 A1 * 8/2001 Mori ..... H01L 21/76229 257/510
2002/0102353 A1 8/2002 Mauthner et al.
2003/0183860 A1 * 10/2003 Uchiyama ..... G03F 9/7076 257/296
2005/0173414 A1 * 8/2005 Ishii ..... H01C 1/01 219/549
2006/0188721 A1 * 8/2006 Irvin, Jr. ..... B44C 1/17 428/402
2006/0222803 A1 10/2006 Husemann et al.
2006/0226228 A1 * 10/2006 Gagne et al. ..... 235/462.01
2006/0257638 A1 * 11/2006 Glatkowski ..... C09D 5/24 428/292.1
2007/0029309 A1 2/2007 Keite-Telgenbuscher et al.
2007/0068630 A1 * 3/2007 Griffin ..... B41M 5/282 156/387
2007/0298253 A1 * 12/2007 Hata ..... B82Y 10/00 428/339
2008/0044651 A1 * 2/2008 Douglas ..... B82Y 10/00 428/339
2008/0096113 A1 * 4/2008 Naoe ..... G03F 1/14 430/5
2008/0150165 A1 * 6/2008 Stumbo et al. ..... 257/784
2008/0314626 A1 * 12/2008 Moore ..... G06F 3/0412 174/255
2009/0051196 A1 * 2/2009 Ishii ..... H05B 3/146 297/180.12
2009/0162760 A1 * 6/2009 Hoshino ..... B82Y 10/00 430/30
2009/0235915 A1 * 9/2009 Doumanidis et al. .... 126/263.01
2009/0272337 A1 * 11/2009 Pomponio ..... 119/850
2009/0319971 A1 * 12/2009 Sakakidani ..... G03F 1/144 716/111
2010/0059494 A1 * 3/2010 Keite-Telgenbuscher et al. ..... 219/201
2010/0059495 A1 * 3/2010 D'Haene ..... 219/203
2010/0127242 A1 * 5/2010 Zhou ..... B82Y 10/00 257/24
2011/0017719 A1 * 1/2011 Choi et al. ..... 219/260
2011/0036826 A1 * 2/2011 Feng et al. ..... 219/409
2011/0036829 A1 * 2/2011 Fugetsu ..... H05B 3/145 219/541
2011/0056929 A1 * 3/2011 Feng ..... H05B 3/22 219/546
2011/0146912 A1 * 6/2011 Howarth ..... B41M 5/282 156/350
2011/0155713 A1 * 6/2011 Wang et al. ..... 219/203
2011/0156219 A1 * 6/2011 Kawashima ..... H01L 22/34 257/620
2011/0204038 A1 * 8/2011 Feng et al. ..... 219/213
2011/0272392 A1 * 11/2011 Dohring ..... F24D 13/024 219/213
2012/0190590 A1 * 7/2012 Wohlstadter ..... B01L 3/5085 506/39
2012/0241889 A1 * 9/2012 Takemura ..... H01L 51/448 257/431
2013/0107563 A1 * 5/2013 McCabe ..... G02F 1/157 362/540
2014/0016048 A1 * 1/2014 Omote ..... G06F 3/044 349/12

FOREIGN PATENT DOCUMENTS

DE 19711522 C2 10/1998
DE 10136549 A1 2/2003
DE 102004044352 A1 3/2006
DE 202005013822 U1 9/2006
DE 202005014678 U1 9/2006
EP 1227999 B1 8/2002
EP 1865440 A 12/2007
GB 2279544 A 1/1995
WO 2004081136 A 9/2004
WO 2006063064 A 6/2006
WO 2006122736 A 11/2006

OTHER PUBLICATIONS

I. Szleifer, R. Yerushalmi-Rozen, "Polymers and Carbon Nanotubes—dimensionality, interactions and nanotechnology", Polymer 46 (2005) p. 7803.

Ray H. Baughman, Anvar A. Zakhidov, Walt A. de Heer, "Carbon Nanotubes—the Route Toward Applications", Science's Compass 297; p. 787.

(56) References Cited

OTHER PUBLICATIONS

German Search Report, Deutsches Patent-und Markenamt dated Aug. 13, 2007.

International Search Report from the European Patent Office mailed Jun. 9, 2008.

M. Rezaul Karim, Chul Jae Lee, Mu Sang Lee, "Synthesis and Characterization of Conducting Polythiophene/Carbon Nanotubes Composites" Journal of Polymer Science Part A: Polymer Chemistry, vol. 44 (2006); p. 5283.

R. Shvartzman-Cohen, Y. Levi-Kalisman, E. Nativ-Roth, R. Yerushalmi-Rozen, "Generic Approach for Dispersing Single-Walled Carbon Nanotubes: The Strength of a Weak Interaction" Langmuir vol. 20, No. 15 (2004); pp. 6058-6088.

Z. Wu, Z. Chen, X. Du, J.M. Logan, J. Sippel, M. Nikolou, K. Kamaras, J.R. Reynolds, D.B. Tanner, A.F. Hebard, A.G. Rinzler, "Transparent, Conductive Carbon Nanotube Films", Science vol. 305 (2004); p. 1273.

* cited by examiner

HEATING ELEMENT, AND HEATABLE PANE COMPRISING A HEATING ELEMENT

This is an application filed under 35 USC §371 of PCT/EP2008/050248, filed on Jan. 10, 2008, claiming priority to DE 10 2007 004953.8 filed on Jan. 26, 2007.

BACKGROUND OF THE INVENTION

The invention relates to a heating element comprising an electrical current conductor and also to a heatable pane comprising such a heating element.

For heat generation in a heating element it is usual for current to be passed through a current conductor. In this arrangement, as a result of a drop in voltage at an ohmic resistor, electrical energy is converted into heat energy. Heating elements of this kind are used for multifarious purposes. For the use of heating elements in the case of heatable panes it is known to insert thin wires into the pane and to use these wires as current conductors for the purpose of heating the pane. In addition to relatively high production costs, this entails obstructions to vision and also nonuniform heating of the pane.

The pane referred to encompasses not only mineral glass panes but also panes made of plastic glasses. The use of panes of this kind with a heating element is of interest in particular for motor vehicles and aircraft. Possible fields of application, additionally, are heatable visors of protective helmets, such as motorcycle helmets or mirrors or displays of measuring instruments which are used, for example, in polar regions.

The use of electrically conductive films as a heating element is also known. Their field of use, however, is limited, owing to a limited current flow through them, and to inadequate transparency. At increased current flow, there is often damage to these conductive films, which impairs their functionality. Moreover, the intrinsically conductive polymers that are used in such films have a low long-term stability.

BRIEF SUMMARY OF THE INVENTION

It is an object of the invention to specify a heating element which allows uniform heating of an area and at the same time is robust, easy to mount, and inexpensive.

The present invention is achieved, in the case of a heating element having the features of the precharacterizing clause of claim 1, by the features of the characterizing clause of claim 1. Preferred embodiments and developments are subject matter of the dependent claims.

In accordance with the invention it has been recognized that it is advantageous to use a transparent planar structure or tapelike structure, referred to below only as planar structure, as a heating element. The planar structure is constructed from at least three layers each having different functionalities: a backing layer, a current-conducting layer, and an adhesive layer. These layers are all transparent, and so the heating element as such is likewise transparent and can also be used in conjunction with panes.

The use of the plurality of layers with different functions produces a decoupling of the functionalities, which makes it possible to tailor each layer to the particular requirements. As a result it is possible to realize requirements relating to the heating element more simply and more cost effectively for a wide variety of different uses. The backing layer serves as a carrier for the two other layers. The backing ought to be made such that the structure as a whole is sufficiently flexible and can be applied effectively. The current-conducting layer serves to fulfill the actual heating function. Accordingly, it ought to permit a sufficiently high flow of current. Furthermore, a flow of current through the other layers ought largely to be avoided. The adhesive layer in turn serves for the application of the planar structure to any desired substrates. Depending on the substrate and the field of application, then, there are particular requirements to be met, such as high bond strength, temperature stability and weathering resistance, and the like. The layer construction has a further advantage in that the current-conducting layer is disposed between the backing layer and the adhesive layer. This arrangement has the advantage that the current-conducting layer is protected against adverse external influences, such as scratching, for example, and against effects of weathering.

By transparency in the sense of the invention is meant a light transmittance of at least 50% of the irradiated intensity. This transmittance can be determined in accordance, for example, with DIN 5036 part 3 or ASTM D 1003-00. In a preferred embodiment a light transmittance of at least 70% is achieved.

In a preferred embodiment the current-conducting layer is designed such that it allows substantially uniform heating over the planar structure. The temperature difference in the plane of the planar structure ought accordingly—apart from marginal regions in the region, for example, of the contacting—not to be greater than 20% of the maximum final temperature attained in the plane of the planar structure.

As an alternative, however, it is also possible to provide deliberately for regions in which the heating power is increased—in other words, to mandate a temperature gradient with respect to the heating power through the construction of the heating element. This can be done, for example, by a regionally increased thickness of the current-conducting layer. As a result of such a design it is possible for temperature gradients that customarily occur in a pane, as a result, for example, of regionally quicker cooling as a consequence of air turbulences, to be compensated. Since, however, effects of this kind are speed-dependent, it has to be accepted that the heating power may be increased in the corresponding regions at speeds other than the intended speed.

The current-conducting layer preferably fulfils the heating function such that the heating element attains a heating rate in air, starting from room temperature, of at least 1° C./min, more preferably at least 3° C./min. Under the stated conditions the heating power ought to be sufficient for a temperature increase of at least 3° C., preferably for a temperature increase of at least 5° C.

In accordance with claim 2 the current-conducting layer is designed such that at least 90%, preferably 95%, more preferably 98% of the current that flows overall through the heating element flows through this layer. This can be realized, for example, through a corresponding thickness of the current-conducting layer and/or through a correspondingly selected concentration of carbon nanotubes in said layer. A development preferred in this way has the advantage that accident hazards are avoided as a result of the subordinate conductivity of the other layers.

In accordance with claim 3 the current-conducting layer comprises carbon nanotubes (CNT). These materials are enormously conductive and, as a result of their fibrous structure, are also readily able to develop a conductive network, with the consequence that, by this means, a conductivity which is sufficient for heat generation is achieved even in the case of a very low fraction in the current-conducting layer. This makes it possible, in a particularly simple way, to achieve the desired transparency of the current-conducting layer. In order to achieve sufficient conductivity, the carbon nanotubes ought to be used as a filler in an amount of at least 0.01% by weight.

For certain fields of application of the heating element, furthermore, it may be desirable if said element has regions with different heating power—that is, the heating power obtained in the marginal region, for example, is higher than that in the middle of the heating element, or vice versa. Such different heating powers within the heating element can be realized in a simple way by means, for example, of a regionally different thickness of the current-conducting layer, in which a higher heating power is to be achieved, and/or by means of a regionally different concentration of carbon nanotubes within the current-conducting layer.

In a further preferred embodiment, the current-conducting layer is composed essentially of carbon nanotubes themselves without further additions such as binders, for example. In that case the anchoring of the layer on the backing material is brought about substantially by means of van der Waals forces, and is supported by the adhesive layer above it.

A further advantageous embodiment in accordance with claim 5 is that in which the carbon nanotubes are embedded in a transparent matrix. In this way the carbon nanotubes can be durably fixed in the layer and shielded from external effects, as a result of which it is possible to achieve an increased long-term stability. Moreover, with a high transparency of the matrix, there is an increase in the overall transparency of the heating element.

As a matrix material it is preferred to use a polymeric binder which is converted into the current-conducting layer from a solution or dispersion in one or more organic solvents or water. This conversion process can be accomplished, for example, by coating the solution or dispersion onto the backing material and then evaporating off the solvent or dispersion medium. It is advantageous here that it is easier to produce very thin and hence highly transparent layers from the solution or dispersion than from 100% systems, i.e., systems which contain no solvent and no dispersion medium, such as radiation-curing coating materials, for example. Moreover, from a market standpoint, there are already carbon-nanotube dispersions in organic solvents and water available (e.g., from the companies Eikos, Boston, under the trade name Invisicon™; Zyvex, Richardson (Texas, USA), under the trade name NanoSolve®, and FutureCarbon GmbH, Bayreuth) that can easily be dispersed into such binder systems.

In accordance with claim 7, the monomers serving to prepare the matrix material are selected in particular such that the resulting polymers can be used as pressure-sensitive adhesives at room temperature or higher temperatures, preferably in such a way that the resulting polymers possess pressure-sensitive adhesive properties in accordance with the "Handbook of Pressure Sensitive Adhesive Technology" by Donatas Satas (van Nostrand, New York 1989). As a result of the glass transition temperature, which for these materials frequently lies below room temperature, and as a result of the low crosslinking density with correspondingly low modulus of elasticity, the carbon nanotubes require a high mobility, and this leads to a reinforcement of network formation. As a result, the amount of carbon nanotubes used can be reduced, which raises the transparency and lowers the costs.

To obtain a polymer glass transition temperature $T_g \leq 25°$ C., as is preferred for pressure-sensitive adhesives (PSAs), and which is determined by means of differential scanning calorimetry, the monomers are very preferably selected, and the quantitative composition of the monomer mixture advantageously chosen, in such a way, and in accordance with the remarks above, as to give the desired $T_g$ value for the polymer in accordance with the Fox equation (E1) (cf. T. G. Fox, Bull. Am. Phys. Soc. 1 (1956) 123).

$$\frac{1}{T_g} = \sum_n \frac{W_n}{T_{g,n}} \quad \text{[E1]}$$

In this equation, n represents the serial number of the monomers used, $W_n$ the mass fraction of the respective monomer unit n (% by weight), and $T_{g,n}$ the respective glass transition temperature of the homopolymer obtained from the respective monomers n, in K.

Particularly suitable as an adhesive component are acrylate PSAs which are obtainable, for instance, by free-radical addition polymerization and which are based at least partly on at least one acrylic monomer of the general formula (1)

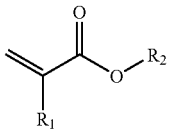

(1)

where $R_1$ is H or a $CH_3$ radical and $R_2$ is H or is selected from the group of saturated, unbranched or branched, substituted or unsubstituted $C_1$ to $C_{30}$ alkyl radicals. The at least one acrylic monomer ought to have a mass fraction of at least 50% in the PSA. Advantageous features of the acrylate PSAs are their high transparency and also their good thermal and aging stability.

In one advantageous embodiment there are at least two surface regions provided in the heating element, through which current can be passed into the current-conducting layer. These surface regions are provided in the plane of the adhesive layer, and in these regions there is no adhesive layer or there is a different kind of electrically conductive layer—different, that is, than the current-conducting layer. This different kind of layer need not necessarily be transparent, since it is intended merely for the electrical contacting of the conducting layer and is therefore disposed preferably only in the edge regions of the heating element. The electrical conductivity of this layer is at least 10 times higher than the electrical conductivity of the current-conducting layer. This has the advantage that the layer which substantially conducts the current can be joined more easily to a current source located outside the heating element than would be possible via the end faces of the heating element.

Connection to the current source is achieved alternatively, in a further advantageous embodiment, by means of two further transparent layers which are disposed above and below the current-conducting layer and which are likewise electrically conductive, the electrical conductivity of these layers being at least 10 times higher than that of the current-conducting layer. These layers may be composed, for example, of vapor-deposited, sputter-applied or particulate metallic or metal-oxidic layers, such as indium-tin oxide (ITO), for example, or else of intrinsically conductive polymers, as are obtainable, for example, under the trade name Baytron from H.C. Starck (Leverkusen). A construction of this kind is shown in FIG. 2.

Carbon nanotubes are microscopically small tubular structures (molecular nanotubes) made of carbon. Their walls, like those of the fullerenes or like the planes of graphite, are composed only of carbon, the carbon atoms adopting a honeycomblike structure with hexagons and three bond partners in each case (dictated by the $sp^2$ hybridization). The diameter of the tubes is in the range from 0.4 nm to 100 nm. Lengths of 0.5 μm up to several millimeters for individual tubes, and up to 20 cm for tube bundles, are attained.

Distinctions are made between single-walled and multi-walled tubes, between open or closed tubes (with a lid which has a section from a fullerene structure), and between empty and filled tubes.

Depending on the detail of the structure, the electrical conductivity within the tubes is metallic or semiconducting. There are also carbon tubes known which are superconducting at low temperatures.

The journal "Science" has published a paper with the title "Carbon Nanotubes—the Route Toward Applications" (Ray H. Baughman, Anvar A. Zakhidov, Walt A. de Heer, Science 297, 787 (2002)). Also published is a paper with the title "Transparent, Conductive Carbon Nanotube Films" (Z. Wu, Z. Chen, X. Du, J. M. Logan, J. Sippel, M. Nikolou, K. Kamaras, J. R. Reynolds, D. B. Tanner, A. F. Hebard, A. G. Rinzler, Science 305, 1273 (2004)). Neither of these papers is concerned with the problem to be addressed here, namely that of making the transparency of glazing less dependent on weathering in means of transport such as, for instance, motor vehicles, locomotives, or aircraft.

The carbon nanotubes may also be constructed of two to about 30 graphitelike layers, and when there are two layers are frequently also referred to as double-walled carbon nanotubes (DWNTs). The walls of the single-walled carbon nanotubes (SWNTs) and also of the multi-walled carbon nanotubes (MWNTs) may have a "normal" structure, an armchair structure, a zigzag structure or a chiral structure, which differ in the degree of twist. The diameter of the CNTs can be between less than one and 100 nm, it being possible for the tubes to adopt a length of up to one millimeter ("Polymers and carbon nanotubes—dimensionality, interactions and nanotechnology", I. Szleifer, R. Yerushalmi-Rozen, Polymer 46 (2005), 7803).

For the heating element of the invention it is advantageous to use carbon nanotubes having an average length of more than 10 μm, since, with increasing length, fewer carbon nanotubes are used for sufficient conductivity, and hence there is an increase in the transparency of the heating element.

Advantageous for the heating element of the invention, furthermore, is the use of carbon nanotubes having an average outer diameter of less than 40 nm. With carbon nanotubes, a decreasing outer diameter is accompanied by an increase in mobility, thereby making it easier for a network to form and consequently meaning that fewer carbon nanotubes are used for sufficient conductivity. By reducing the amount of carbon nanotubes used it is possible to increase the transparency of the heating element. Furthermore, as the outer diameter goes down, there is a fall in the scattering of light by the carbon nanotubes themselves, with the consequence again of an increase in transparency.

It is particularly preferred if the carbon nanotubes have an average ratio of length to outer diameter of at least 250, since in this case, through the combination of the abovementioned advantages relating to length and diameter, it is possible to achieve particularly high transparency in conjunction with sufficient electrical conductivity.

In certain embodiments it is advantageous for the surface of the carbon nanotubes to be chemically functionalized or otherwise modified. Chemical modification simplifies the mixing and/or dispersing with the polymer matrix, since it facilitates the individualization of the carbon nanotubes. In certain embodiments, the chemically modified CNTs may also interact sterically with the polymer matrix, and in other embodiments, in turn, the chemical interaction comprises covalent attachment of the CNTs or CNT derivatives to the polymer matrix, which leads to crosslinking and hence to an advantageously high mechanical stability of the layer. Modified carbon nanotubes are obtainable for example from the companies FutureCarbon, Bayreuth, and Zyvex, Richardson (Texas, USA), under the trade name NanoSolve®.

In one preferred embodiment of the heating element the carbon nanotubes show a single carbon layer in the end-face view, and hence are single-walled carbon nanotubes. The single-walled carbon nanotubes scatter light less than multi-walled carbon nanotubes, and so it is possible to achieve a comparatively greater transparency.

In an otherwise preferred embodiment of the heating element the carbon nanotubes show a plurality of carbon layers in the end-face view—that is, double-walled or multi-walled carbon nanotubes are used. These can be acquired at lower cost in relation to the single-walled carbon nanotubes.

It is also advantageous when the carbon nanotubes within the current-conducting layer are oriented in one preferential direction. This orientation takes place advantageously in the direction of the current flow that is dictated by the position of the contact electrodes. As a result of the orientation, a network of carbon nanotubes stretched in the direction of current flow is produced, which ensures a sufficient electrical conductivity at a lower concentration of carbon nanotubes than is necessary in an isotropic network. The reduced concentration is accompanied by an improvement in the transparency and a reduction in the costs.

The orientation may be achieved, for example, in the course of the coating of the layer which substantially conducts the current, from a liquid phase, by rheological effects (shearing or elongation in the flow). It is also possible to utilize the application of an electrical voltage or of an external electromagnetic field to the layer which is still fluid after application. Furthermore, orientation at crystallite boundaries is possible, as in the case, for example, of partially crystalline polymers, which are stretched preferably below the crystallization temperature, or at phase boundaries of multiphase matrix systems, such as, for example, block copolymers with preferably cylindrical or lamellar morphology. Also possible is the orientation of the carbon nanotubes at structures which are present in the backing layer or the adhesive layer, as is known from the field of liquid crystal polymers (LCPs).

Although the carbon nanotubes are among the most conductive fillers there are, it may nevertheless be advantageous to add further conductive components to the current-conducting layer, since by this means it is possible to lower costs or increase the conductivity and/or transparency. Suitable additives are nanoscale metal oxides, especially indium-zinc oxide or otherwise-doped zinc oxides. The addition of intrinsically conductive polymers as well is advantageous in this context ("Synthesis and Characterization of Conducting Polythiophene/Carbon Nanotubes Composites", M. S. Lee et al., J. Pol. Sci. A, 44 (2006) 5283).

In a further advantageous embodiment of the heating element the adhesive layer is designed as a self-adhesive layer (pressure-sensitive adhesive). Self-adhesives are permanently tacky at room temperature, and thus have a sufficiently low viscosity and a high tack, and hence they wet the surface of the respective adhesive substrate even in the case of a small applied pressure. This presentation form is easier to manage than hotmelt adhesives or liquid adhesive systems, requires no heating or other supply of energy on application, and is generally free from chemical reactions after application.

An acrylate-based adhesive for the purposes of this invention is any adhesive which, in addition to other, optional constituents, comprises a base adhesive whose adhesive properties are determined, or at least substantially codetermined, by a polymer whose basic framework features acrylic monomers.

Suitable more particularly as a self-adhesive layer are acrylate PSAs which are based at least partly on at least one acrylic monomer. Advantages of the acrylate PSAs are their high transparency and also their good thermal and aging stability.

The group of the acrylic monomers is composed of all compounds having a structure which can be derived from the structure of unsubstituted or substituted acrylic acid or methacrylic acid or else from esters of these compounds, and which can be described by the general formula $CH_2{=}C(R^1)(COOR^2)$, it being possible for the radical $R^1$ to be a hydrogen atom or a methyl group and for the radical $R^2$ to be a hydrogen atom, or else the radical $R^2$ is selected from the group of saturated, unbranched or branched, substituted or unsubstituted $C_1$ to $C_{30}$ alkyl groups. The polymer of the base adhesive of the acrylate-based adhesive preferably has an acrylic monomer content of 50% by weight or more.

Acrylic monomers which can be used are in principle all of the above-described group of these compounds, their specific selection and their proportions being dependent on the particular requirements arising from the intended field of use.

Particularly suitable as a base polymer are those acrylate-based polymers which are obtainable, for instance, by free-radical addition polymerization.

In a further advantageous embodiment the heating element is characterized in that the self-adhesive is a styrene block copolymer adhesive. This has the advantage that such adhesives adhere well even to nonpolar substrates and, additionally, feature very good transparency and also, in the case of hydrogenated polymer types, a very good aging stability as well.

Besides the base adhesive, the self-adhesive may of course also comprise further additives such as, for example, fillers, especially nanoscale fillers which do not scatter the light and hence maintain the transparency, rheological additives, additives for improving the adhesion, plasticizers, resins, elastomers, aging inhibitors (antioxidants), light stabilizers, UV absorbers and also other auxiliaries and additives, examples being flow and leveling agents and/or wetting agents such as surfactants, or catalysts.

With further preference the heating element is characterized in that the self-adhesive has a transparency of greater than 70%, preferably greater than 80%, more preferably greater than 90%. This can be realized, for example, at a layer thickness of 30 μm. An advantage of the high transparency is that the heating element as a whole has an increased transparency. Besides the appropriate selection of the polymers and additives, a high transparency of this kind is produced by a low gel fraction (i.e., domains which partially have a higher degree of crosslinking and which scatter the light) in the adhesive itself and also through the use of very smooth liner material with which the self-adhesive can be lined after coating. The latter measure produces a very smooth surface to the self-adhesive layer, which causes less scattering and reflection of the light. The roughness $R_z$ accordingly is less than 0.5 μm, preferably less than 0.3 μm in accordance with DIN EN ISO 4287.

Heating elements of the invention can be employed in particular for heatable panes, whether of mineral glass or of plastic glass such as Plexiglas, for instance, preferably for a motor vehicle, including, in particular, for exterior rearview mirrors, or for an aircraft. Further fields of use of such panes of glass are helmet visors or eyewear glass, for ski goggles, for example. In these and many other fields of application it is advantageous to place a limit on the transparency of the heating element, since it is then able to act simultaneously as a dazzle prevention means.

Accordingly a further-preferred embodiment of the heating element has a transparency of not more than 80%. This can be achieved, for example, by coloring of backing material and/or of adhesive layer. It is preferred, however, to select the type of carbon nanotubes used in the layer which substantially conducts the current in such a way as to achieve the desired degree of transparency in this layer in conjunction with sufficient heating function. This has the advantage that there are no further measures that need be taken in backing material and layer of adhesive for the purpose of adjusting the transparency.

DETAILED DESCRIPTION OF THE INVENTION

Figure 1:
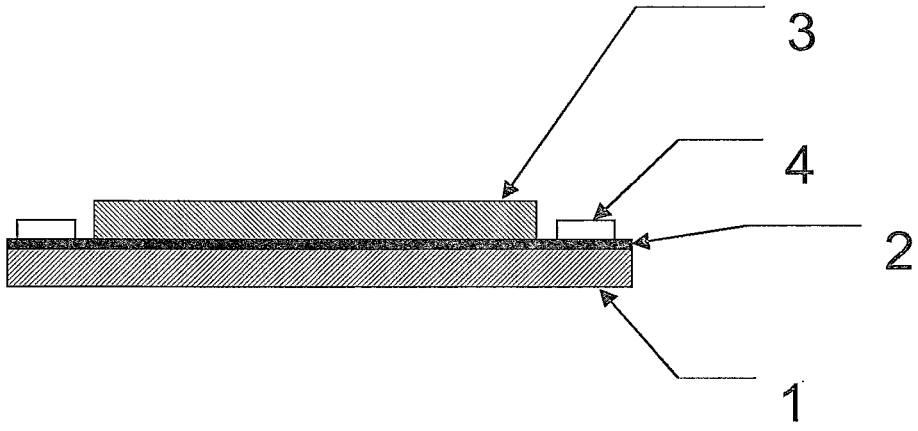
FIG. 1 shows a schematic view a heating element of the invention.

FIG. 1 shows in a schematic view a heating element of the invention configured as a planar structure. The planar structure has a backing layer 1, a current-conducting layer 2, and an adhesive layer 3. The current-conducting layer 2 is disposed between backing layer 1 and adhesive layer 3, so as to be largely protected from effects of weathering.

Also visible in FIG. 1 is electrical contacting 4 for the current-conducting layer 2. For this purpose, in two surface regions which in this case, and preferably, are located at the edge of the heating element, there is no adhesive layer 3. Instead, at those points the current-conducting layer 2 is covered with a different kind of electrically conductive layer with a greater electrical conductivity 4. This different kind of electrically conductive layer allows current to be fed into the current-conducting layer 2.

Figure 2:
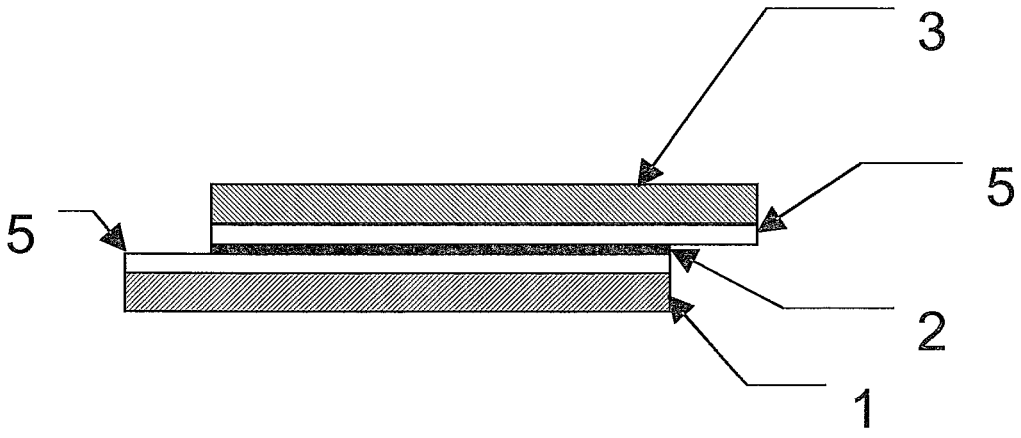
FIG. 2 shows another embodiment of the invention.

FIG. 2 shows in a schematic view a further heating element of the invention which is configured as a planar structure. The planar structure has a backing layer 1, a current-conducting layer 2, and an adhesive layer 3. The current-conducting layer 2 is disposed between backing layer 1 and adhesive layer 3.

Furthermore, FIG. 2 shows electrical contacting for the current-conducting layer 2. For this purpose, two further transparent layers 5 are disposed above and below the current-conducting layer 2, and are likewise electrically conductive, these layers 5 having an electrical conductivity which is at least 10 times higher than that of the current-conducting layer 2. As a result of these different kinds of electrically conductive layers 5, it is possible to feed current into the current-conducting layer 2.

Figure 3:
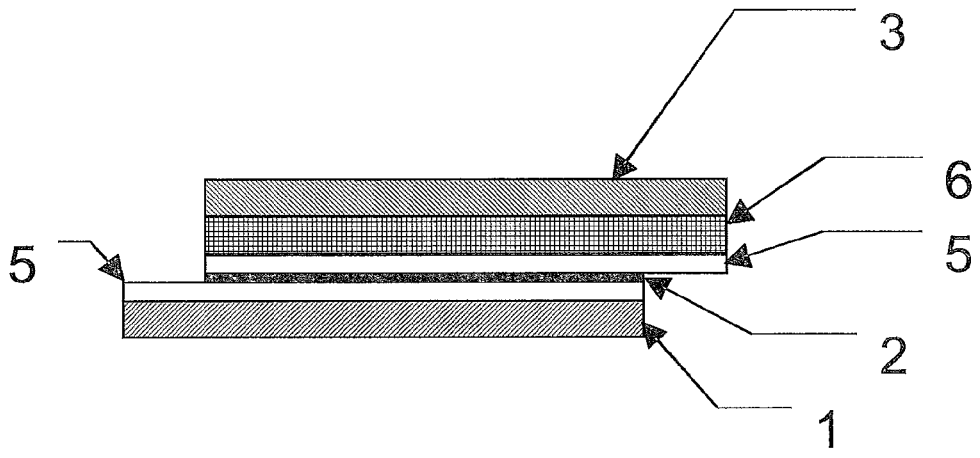
FIG. 3 shows a construction utilizing the heating element of the invention.

FIG. 3 shows a construction of the invention as in FIG. 2, where a further layer 6 is disposed between the layer 5 of relatively high electrical conductivity, which is assigned to the adhesive layer 3, and the current-conducting layer 2; said further layer 6 stabilizes the layer 5 of higher electrical conductivity in order to avoid fractures in that layer 5 and hence to ensure a more durable contact.

Figure 4:
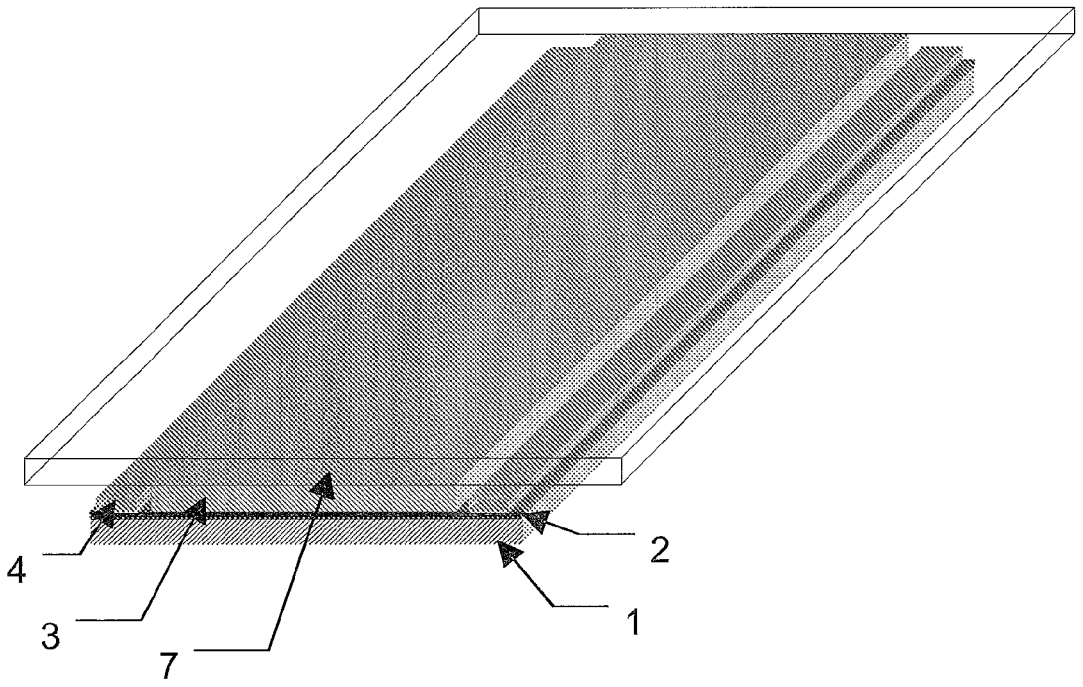
FIG. 4 shows a construction of the invention.

FIG. 4 shows a heatable pane 7 of the invention with a heating element whose construction is as described in FIG. 1.

Elucidated in more detail below, with reference to examples, is the construction of a heating element of the invention.

EXAMPLE 1

An aqueous dispersion of carbon nanotubes was prepared. This was done using the method of Yerushalmi-Rozen et al. (R. Shvartzman-Cohen, Y. Levi-Kalisman, E. NativRoth, R. Yerushalmi-Rozen, Langmuir 20 (2004), 6085-6088), in which triblock copolymers (PEO-b-PPO-b-PEO) are used as stabilizers. The middle block has a higher affinity for the CNTs than the end blocks, which lead, owing to the large hydrodynamic radius, to steric interactions between the carbon nanotubes. The hydrodynamic radius of the stabilizers is greater than the range at which the van der Waals forces are still effectively active.

Carbon nanotubes used were as follows: ATI-MWNT-001 (multi-walled CNT, unbundled as grown, 95% form, 3 to 5 layers, average diameter 35 nm, average length 100 μm, from Ahwahnee, San Jose, USA).

The stabilizer used was as follows: PEO-b-PPO-b-PEO block copolymer having a molar weight $M_n$ of 14 600 g/mol (PEG=80% (w/w), Aldrich No. 542342). The stabilizer was dissolved at a concentration of 1% by weight in demineralized water.

Then a 1% by weight dispersion of carbon nanotubes in this solution was prepared, using an ultrasound bath as a dispersing aid. After four hours of ultrasound treatment, about 70% of the CNTs were dispersed (visual estimate), and the dispersion was stable over several days before further processing. The undispersed nanotubes were removed by filtration.

The dispersion was knife-coated onto a PET film 23 μm thick, and the applied dispersion was dried, to give a dry film thickness of approximately 0.1 μm.

A layer approximately 20 μm thick of an acrylate PSA (acResin 258 from BASF, crosslinked with 36 mJ/cm$^2$) was then laminated onto the conductive layer, with a stripe left free at the edges. This region was then brushed with a stripe of conductive silver varnish. A schematic drawing of this heating element is shown in FIG. 1. The distance between the contact stripes was 5 cm; the length of the heating element was 10 cm.

With an applied voltage of 12.8 V, the heating element showed a heating rate of approximately 10° C./min and, starting from room temperature, attained an equilibrium temperature of 39° C., which was measured on the adhesive.

The transmission measurement through the heating element in accordance with DIN 5036-3 gave a transmittance τ of 63%.

EXAMPLE 2

An aqueous binder dispersion filled with about 0.05% by weight (based on the binder fraction) of single-walled carbon nanotubes, which can be acquired from Eikos, Franklin, Mass., USA, was knife-coated onto a PET film 23 μm thick, and the applied dispersion was dried, to give a dry film thickness of approximately 0.5 μm. A layer approximately 20 μm thick of an acrylate PSA (acResin 258 from BASF, crosslinked with 36 mJ/cm$^2$) was then laminated onto the conductive layer, with a stripe left free at the edges. This region was then brushed with a stripe of conductive silver varnish. A schematic drawing of this heating element is shown in FIG. 1. The distance between the contact stripes was 5 cm; the length of the heating element was 10 cm.

With an applied voltage of 12.8 V, the heating element showed a heating rate of approximately 6° C./min and, starting from room temperature, attained an equilibrium temperature of 28° C., which was measured on the adhesive.

The transmission measurement through the heating element in accordance with DIN 5036-3 gave a transmittance τ of 72%.

EXAMPLE 3

A toluenic solution containing 20% by weight of an acrylate PSA (acResin 252 from BASF, Ludwigshafen) was admixed in a ratio of 5:1 with a dispersion of 1% by weight of single-walled carbon nanotubes in toluene, from Zyvex, thus giving a fraction of about 0.01% by weight of carbon nanotubes relative to the acrylate PSA.

The dispersion was knife-coated onto a PET film 23 μm thick, and the applied dispersion was dried, to give a dry film thickness of approximately 2 μm. This layer was crosslinked by means of UV radiation, using a medium-pressure mercury lamp, with a UV-C dose of 36 mJ/cm$^2$.

A layer approximately 20 μm thick of an acrylate PSA (acResin 258 from BASF, crosslinked with a UV-C dose of 36 mJ/cm$^2$) was then laminated onto the conductive layer, with a stripe left free at the edges. This region was then brushed with a stripe of conductive silver varnish. A schematic drawing of this heating element is shown in FIG. 1. The distance between the contact stripes was 5 cm; the length of the heating element was 10 cm.

With an applied voltage of 12.8 V, the heating element showed a heating rate of approximately 15° C./min and, starting from room temperature, attained an equilibrium temperature of 45° C., which was measured on the adhesive.

The transmission measurement through the heating element in accordance with DIN 5036-3 gave a transmittance τ of 59%.

The invention claimed is:

1. A heating element comprising: a backing layer, an adhesive layer, a first current-conducting layer for conducting electrical current, wherein, as a result of a drop in voltage, the electrical current is convertible into heat, wherein the first current-conducting layer is disposed between the backing layer and the adhesive layer, wherein the backing layer, the adhesive layer and the first current-conducting layer form a transparent structure, wherein the heating element is in the form of a planar structure defined by a plane, wherein a portion of the first current-conducting layer directly contacts the adhesive layer, and electrical contacts are located at edges of first current-conducting layer apart from the adhesive layer and covered with electrically conductive layer with a greater electrical conductivity than the electrical contacts;

wherein each of the backing layer, the adhesive layer and the first current-conducting layer is transparent, the first current-conducting layer comprises carbon nanotubes, and a drop of voltage results in substantially uniform heating throughout the planar structure;

wherein a temperature difference in the plane of the planar structure, apart from marginal regions in a region of contacting, is no greater than 20% of a maximum final temperature attained in the plane of the planar structure.

2. The heating element according to claim 1, wherein the carbon nanotubes are embedded in a transparent matrix.

3. The heating element according to claim 2, wherein the transparent matrix has a polymeric binder.

4. The heating element according to claim 1, wherein the backing layer is configured such that the heating element, as a whole, is flexible.

5. The heating element of claim 1, wherein the first current conductive layer has regions of varying electrical resistance providing different heating power.

6. The heating element of claim 2, wherein the transparent matrix is prepared from at least one monomer selected such that the resulting polymer is a pressure-sensitive adhesive.

7. The heating element of claim 2, wherein the transparent matrix material is a pressure-sensitive acrylate adhesive.

8. The heating element of claim 1, wherein the carbon nanotubes have an average length of at least 10 μm.

9. The heating element of claim 8, wherein the carbon nanotubes have an average outer diameter of less than 40 nm.

10. The heating element of claim 8, wherein the carbon nanotubes have an average ratio of length to outer diameter of at least 250.

11. The heating element of claim 8, wherein at least one surface of the carbon nanotubes is chemically modified.

12. The heating element of claim 8, wherein the carbon nanotubes are single-walled.

13. The heating element of claim 8, wherein the carbon nanotubes are multi-walled.

14. The heating element of claim 1, wherein the carbon nanotubes comprise a plurality of nanotubes positioned in the direction of the current flow directed by positions of contact electrodes.

15. The heating element of claim 1, wherein the first current-conducting layer further comprises an intrinsically conductive polymer.

16. The heating element of claim 1, wherein the adhesive layer is designed as a self-adhesive layer.

17. The heating element of claim 16, wherein the self-adhesive layer is an acrylate adhesive layer.

18. The heating element of claim 16, wherein the self-adhesive layer is a styrene block copolymer adhesive layer.

19. The heating element of claim 16, wherein the self-adhesive layer has a transparency of greater than 70%.

20. The heating element of claim 1, wherein the first current-conducting layer has a transparency of not more than 80%.

21. The heating element according to claim 14, wherein the first current-conducting layer has regions of varying concentration and/or types of carbon nanotubes.

22. The heating element of claim 1, wherein the first current-conducting layer contains a binder prepared from a solution or dispersion in an organic solvents or in water.

23. The heating element of claim 15, wherein the first current-conducting layer comprises conductive components.

24. The heating element of claim 23, wherein the conductive components are intrinsically conductive polymers.

* * * * *